United States Patent [19]

Yamano

[11] 4,101,756

[45] Jul. 18, 1978

[54] ELECTRICALLY HEATED CURLING IRON AND STAND THEREFOR

[76] Inventor: Jiichi Yamano, 288 2-chome Nishiokubo, Shinjuku-ku, Tokyo, Japan

[21] Appl. No.: 667,894

[22] Filed: Mar. 18, 1976

[51] Int. Cl.[2] ..... H05B 1/00; A45D 1/04

[52] U.S. Cl. ..... 219/222; 132/37 R; 219/225; 219/242; 219/247; 219/518; 339/58

[58] Field of Search ..... 219/221–242, 219/533, 246, 247, 250, 259, 518; 339/58; 132/37 R, 37 A, 31 R, 31 A, 32 R, 32 A, 33 R, 7, 9; 248/117.1–117.7

[56] References Cited

U.S. PATENT DOCUMENTS

| | | | |
|---|---|---|---|
| 1,994,877 | 3/1935 | Shoop et al. | 219/247 X |
| 3,398,260 | 8/1968 | Martens | 339/58 X |
| 3,534,392 | 10/1970 | Trouilhet | 219/242 X |
| 3,560,703 | 1/1968 | Chedister | 219/222 |
| 3,892,943 | 7/1975 | Van Droogemboek | 219/242 X |

FOREIGN PATENT DOCUMENTS

| | | | |
|---|---|---|---|
| 652,732 | 10/1928 | France | 219/222 |

*Primary Examiner*—A. Bartis

*Attorney, Agent, or Firm*—Wm. Jacquet Gribble

[57] ABSTRACT

A stand for holding one or more heatable hair curlers or curling irons has a well or receptacle for each curling iron, each well having two contact poles connecting through normally open switches to a source of power to the stand. Each curling iron has a heating element thermally connected to a hair mandrel and electrically connected to separated electrical contact zones on the iron beyond a thermal insulating handle. The handle terminates remote from the mandrel in a reduced actuating tip that passes a restriction in a receptacle and moves a switch actuator to close the switches and supply current to the curling iron heating element, through the contact poles and contact zones. Removal of the iron from the stand closes the switches and no current flows.

1 Claim, 6 Drawing Figures

Fig. 5.
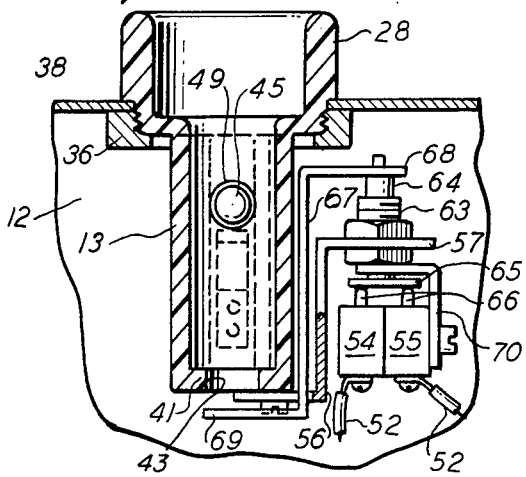
Fig. 6.
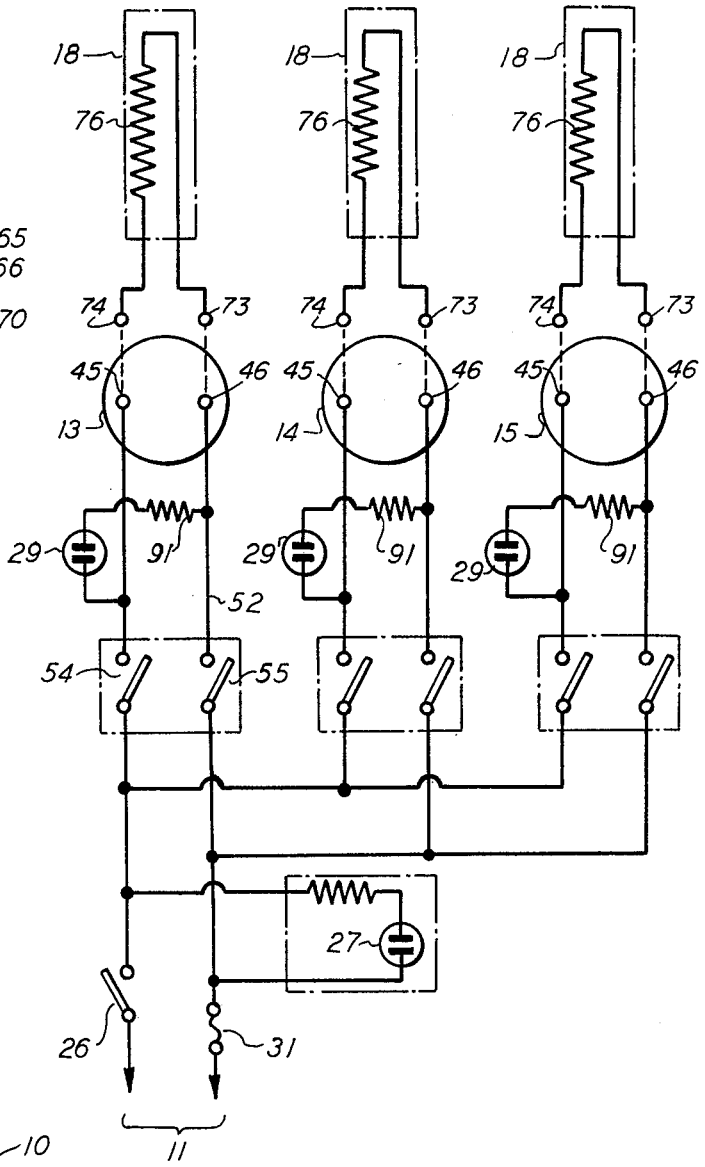
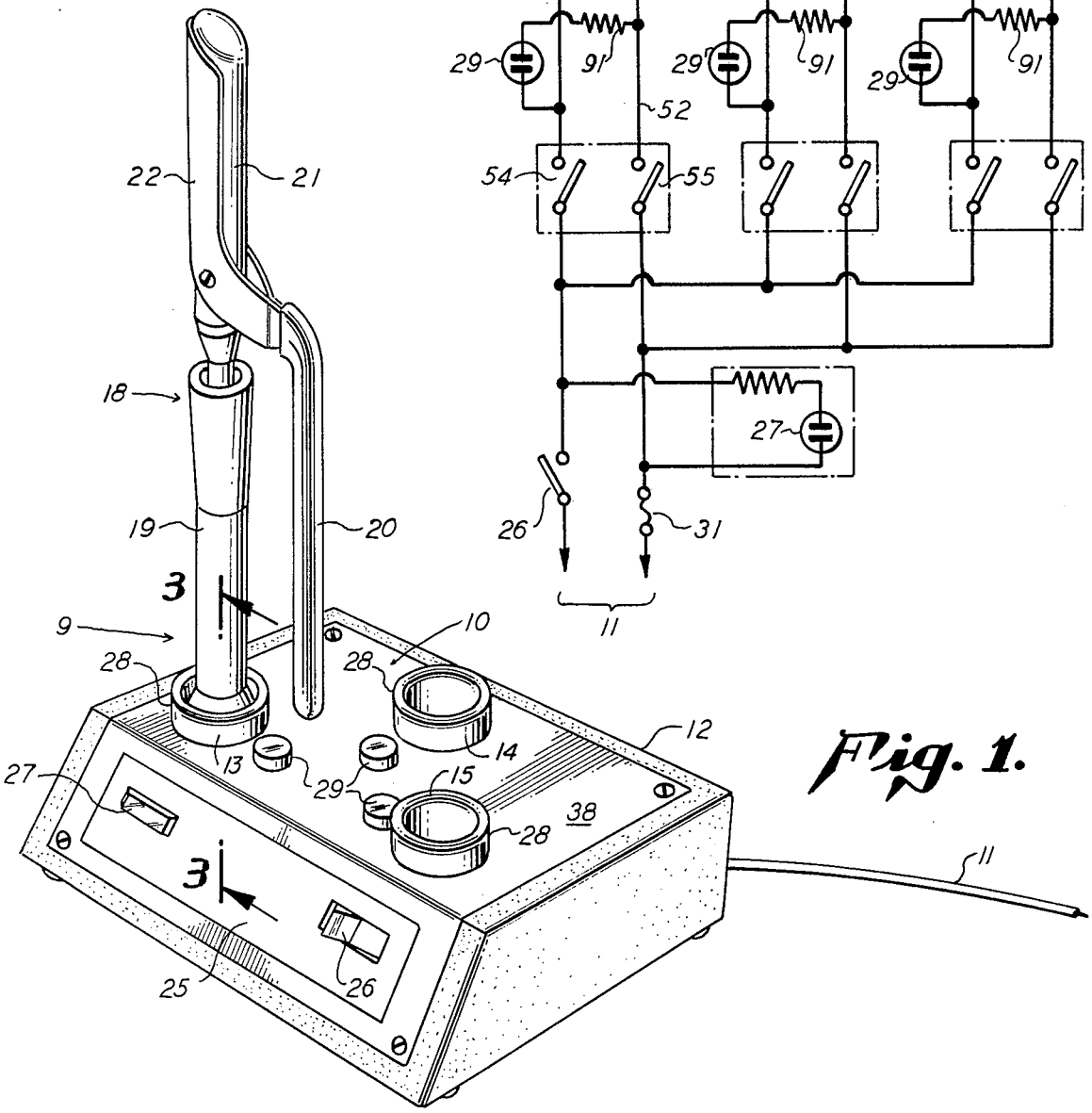
Fig. 1.

ELECTRICALLY HEATED CURLING IRON AND STAND THEREFOR

BACKGROUND OF THE INVENTION

The invention relates to heated devices used for setting curls and waves in human hair, and more particularly to such curling irons which are wireless when in use by the operator. Electrically heated irons for curling hair have been available for years, but have been cumbersome in use because of the wire attached to the curling iron which connected to the source of power. The ideal situation is an iron which may be properly heated electrically but which has no dangling wire connection. Also, it is desirable to have more than one iron at a particular work station, particularly in professional hair parlors, so that an iron of proper heat and diameter is always at hand.

It has been heretofore difficult to supply such a hair curling device which is at once handy for work and safeguarded against electrical hazards such as spilled liquids, metallic probes, and careless fingers. The instant invention is not only electrically and thermally safe, but provides a device of great flexibility in both suitable work places and operators of varied degrees of skill.

SUMMARY OF THE INVENTION

The invention contemplates heating apparatus for hair curling devices which comprises at least one hair curling iron having a hair mandrel section upon which hair is wound, a heat insulated handle and an electrically actuated heating element in the iron thermally connected to the mandrel. The handle is between the mandrel and a plug section having electrically and spatially separated contact zones, preferably metallic bands. An electrically energizable stand has at least one socket or receptacle for a curling iron, with electrically and spatially separated resilient contact poles, each adapted to make electrical contact with a separate contact zone on the curling iron. Electric lines extend from each contact pole through a normally open switch to a source of power in the stand. Switch actuating means associated with each receptacle may be impinged by a curling iron plug section while the iron is in the receptacle to close both normally open switches to establish current flow to the curling iron heating element from the energized stand.

Preferably the receptacle is restricted between the contact poles and the actuating means and the iron plug section is reduced at its entering end such that the actuating means is shielded from impingement by foreign probes.

The curling iron and the stand thus combine to afford a heat device for hair curling irons which is safe, convenient and efficient. The apparatus of the invention can be fabricated from commercially obtainable materials and requires no special training for its use.

These and other advantages of the invention are apparent from the following detailed description and drawing.

BRIEF DESCRIPTION OF THE DRAWING

FIG. 1 is a perspective view of the apparatus of the invention;

FIG. 5 is a fragmentary sectional elevation taken along line 5—5 of FIG. 2; and FIG. 6 is a schematic wiring diagram of the apparatus of the invention.

In the various Figures like parts are identified by like numbers.

DESCRIPTION OF THE PREFERRED EMBODIMENT

Figure 2:
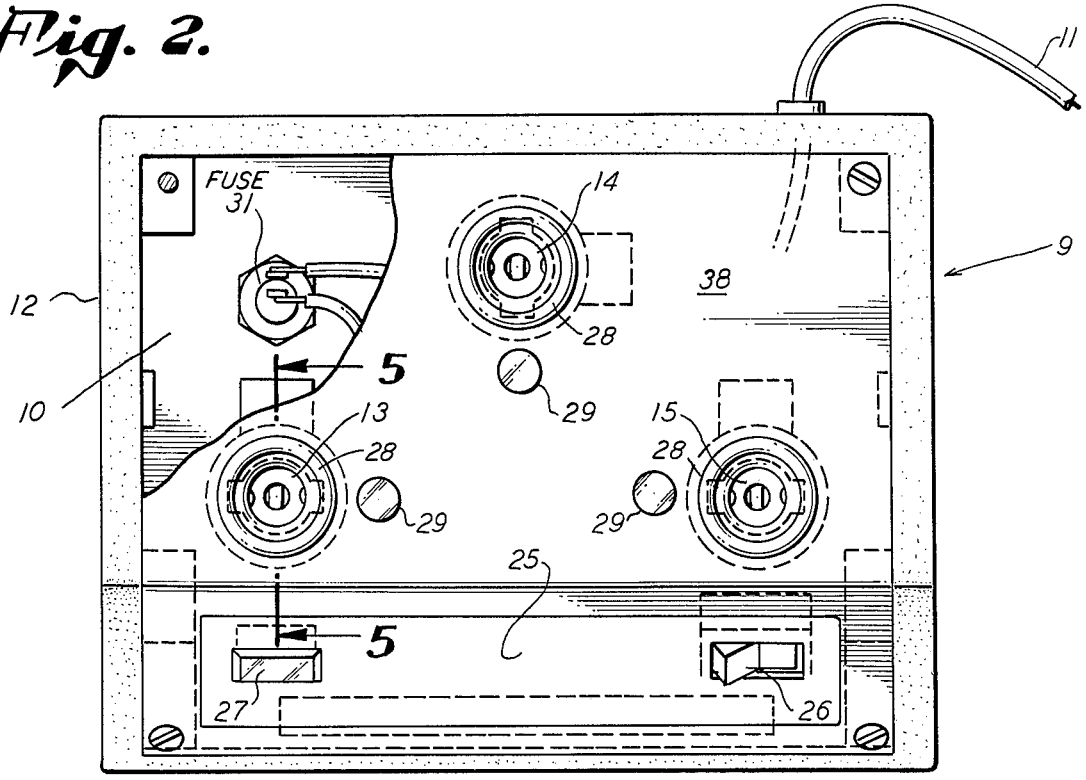
FIG. 2 is a plan view thereof partly broken away and with the curling iron removed.

FIGS. 1 and 2 show the general exterior aspect of the preferred apparatus of the invention embodied in a curling iron heater 9 comprising an energizable stand 10 with a supply cord 11, an outer enclosure 12 and three receptacles or sockets 13, 14, 15, receptacle 13 seating a curling iron 18. The curling iron has a thermally insulated handle 19, a clamping handle 20 hinged to the iron, a hair mandrel 21 against which a clamp 22 compresses the hair (not shown) to be treated.

In FIGS. 1 and 2 the sloping front 25 of the enclosure 12 mounts an on-off switch 26 and an indicator lamp 27 showing when the stand is energized. Each receptacle is seen to have an upper shroud 28 and a glow lamp 29 adjacent the shroud to indicate the on-off condition of the switches of each receptacle individually.

While only one curling iron is seen in the Figures it is obvious that the illustrative embodiment can accommodate three irons. It is also obvious that other embodiments of the invention may use a greater or lesser number of receptacles in the energizable stand and thereby accept various numbers of curling irons. It is also desired to indicate that each of the curling irons associated with a particular stand may have mandrels of differing diameters for differing curling purposes, the diameter of the mandrel being of no significance to the invention.

In addition to the on-off switch and the indicator lamps the line fuse 31 is apparent in FIG. 2, a 1 amp., 125 volt fuse having proved ample for the purpose.

Figure 3:
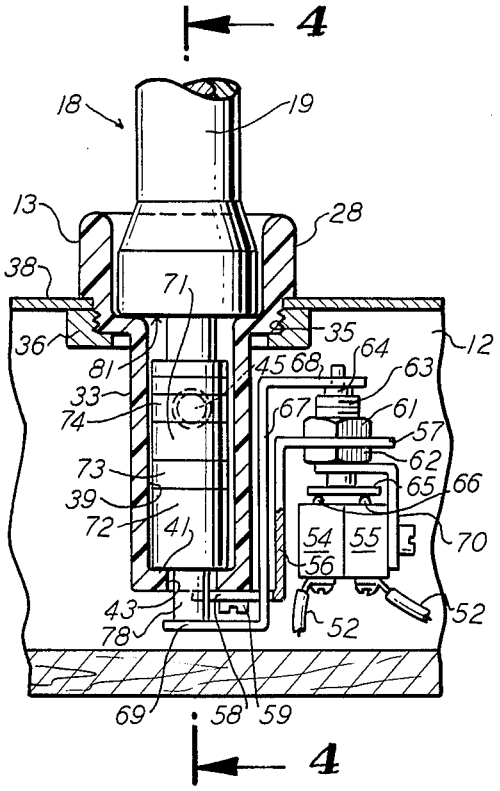
FIG. 3 is a fragmentary sectional elevation taken along line 3—3 of FIG. 1.
Figure 4:
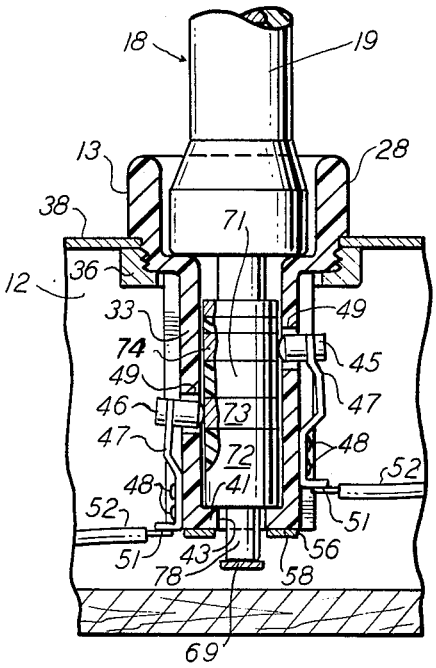
FIG. 4 is a fragmentary sectional elevation taken along line 4—4 of FIG. 3.

The three receptacles of the stand are substantially identical, so a description of one will suffice for all. FIGS. 3, 4 and 5 are illustrative not only of the configuration of the receptacle, but also of the arrangement of the elements of the actuating means by which current is made to flow to the heating element of the iron. Note that the receptacle comprises a tube 33 with the upper shroud 28 having a threaded lower portion 35 engaged with an internally threaded flange 36 fixed to a cover 38 of enclosure 12. The tube continues downwardly in a cylinder 39 ending in a restricting lower wall 41 with a central bore 43. Penetrating into the cylinder 39 are vertically spaced contact poles 45 and 46, which, as can be seen in FIG. 4, are also diametrically opposed on differing vertical levels. Each contact pole is mounted to a resilient strip 47 fixed to the tube as by rivets 48 to load the contact pole inwardly through the orifice 49 in the tube wall. A foot on each resilient strip affords a fixing point 51 for an electrical lead 52 which extends to one of two limit switches 54, 55 associated with each receptacle.

A lesser beam 56 with oppositely extending upper and lower arms 57, 58, respectively, is secured as by screws 59 to lower wall 41. Nuts 61, 62 bind a hollow bushing 63 to upper arm 57 of the lesser beam. An actuating pin 64 rides in the bushing and bears an integral insulating plastic spring leaf 65 that thrusts upon the switch pins 66 of the paired limit switches 54, 55. A greater beam 67 with oppositely extending upper and lower arms 68, 69, respectively, is carried by actuating pin 64 such that its slender lower arm 69 is movable within the confines of the bifurcated lower arm 58 of the lesser beam, directly below the bore 43 of restricting wall 41, best seen in FIG. 4. A yoke 70 attached to upper arm 57 of lesser beam 56 carries the switches As mentioned before, the limit switches 54, 55 are normally open, as shown in FIGS. 5 and 6, wherein the curling iron 18 is outside the stand. In that condition the plastic spring leaf 65 is out of contact with the limit switch pins 66. In FIGS. 3 and 4 the curling iron is residing in the receptacle 13, and a plug shank 71 below the thermal insulated handle 19 is in tube 33. The plug shank comprises a hollow insulated plastic cylinder 72 having two spaced metallic bands 73, 74 vertically separated on its periphery. The bands are separated by insulating plastic and connect, as shown schematically in FIG. 6 with a heating element 76 within the curling iron. The element is in turn thermally connected to the iron mandrel to supply the peripheral heat of the curling iron to perform its hair treating function.

Preferably the heating element is a Bobbin type with a glasfibre tube, although other suitable heaters may be used.

As can be seen in FIGS. 3 and 4, a reduced extension 78 of the plug shank protrudes through central bore 43 of the restricting lower wall 41 to impinge upon arm 69 of greater beam 67, depressing actuating pin 64 and leaf 65 such that switch pins 66 actuate both switches 54, 55. The weight of the curling iron keeps the switches closed and continues the flow of current to the curling iron heat element. A shoulder 81 on the insulated handle 19 precludes overpenetration of the plug shank and its extension in the tube 33.

The strips 47 load the semi-spherical ended contact poles 45 and 46 into the metallic band zones of the plug shank and act like detents to secure the shank in the receptacle. Therefore, the curling iron continues to heat as long as the iron is left in the receptacle. Since the clamp 22 is normally in contact with the heating mandrel, it is desired that clamping handle 20 be thermally insulating. It has been found that silicone materials perform this function well and therefore both the handles 19 and 20 are formed of that material.

It is apparent that the spring leaf 65 rises from switch pins 66 as soon as the curling iron removes from the receptacle. While removal exposes the receptacle to foreign probes, the design of the apparatus protects against harm. Removal of the curling iron opens the switches and no current reaches the contact poles in the tube. The restriction at the tube bottom precludes most articles and all fingers from reaching the actuating arm, such that it is unlikely that the switch will ever be accidentally actuated.

The opening of the receptacle downwardly guards against any casual liquid spills building up a head sufficient to trip the switches, since liquid would pour through the receptacle into the bottom of the enclosure 12 without harm.

In the schematic wiring diagram of FIG. 6 the curling irons 18A are indicated by the broken line rectangles, separated from the receptacles 13A, 14A, 15A indicated by the circles. The indicator lights for the receptacles, to indicate current to the heater element, are each in series with the limit switches associated with the respective receptacle, and connected across a resistor 91 in conventional fashion. Each heater is rated at about 27 watts at 100 volts. Other electrical values are commensurate with that rating.

It has been found that both closure top and receptacles may be fabricated of phenolic plastic economically. Nickel-copper contacts on the plug shank and the contact poles have performed well.

While several variations of the illustrative embodiment have been described, other variations within the scope of the invention will occur to those skilled in the art. It is therefore desired that the invention be measured by the appended claims rather than by the foregoing illustrative disclosure.

I claim:

1. Hair curling apparatus comprising in combination at least one hair curling iron having a hair mandrel, a heat insulating handle, an electrically energized heating element enclosed in the curling iron and heat-conductively joined to the mandrel of the curling iron, electrically and spatially separated electrical contact zones on the curling iron handle remote from said mandrel electrically connected to the heating element, an electrically energizable stand, at least one receptacle on said stand, each adapted to receive the handle of one of said at least one curling iron for supporting the curling iron in the stand, electrically and spatially separated contact poles in each receptacle adapted to make electrical contact each with a separate contact zone on the curling iron handle received in the receptacle, a separate electrical line in the energizable stand electrically connected to each contact pole, a normally open switch having conventional spring-biased switch operators in each electrical line, a lesser beam fixed to each receptacle, said normally open switches being secured in pairs to said lesser beam, an actuating pin journalled in said lesser beam to engage the switch operators of said pair of normally open switches, a greater beam secured to the actuating pin to move therewith, a lower arm on the greater beam; a plug shank on the curling iron handle adapted to contact said lower arm of said greater beam when the handle is inserted into the receptacle, and a spring leaf integral with said actuating pin to transmit thrust between the pin, actuated by impingement of said plug shank on the lower arm of the greater beam, and the switch operators of said pair of switches to close the switches the greater beam being movable from the switch closing position upon removal of the curling iron handle from the receptacle, under the thrust of the spring-biased switch operators.

* * * * *